US008210670B2

(12) United States Patent
Ishizawa et al.

(10) Patent No.: US 8,210,670 B2
(45) Date of Patent: Jul. 3, 2012

(54) LIQUID CONTAINER

(75) Inventors: Taku Ishizawa, Nagano (JP); Takeo Seino, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/025,365

(22) Filed: Feb. 11, 2011

(65) Prior Publication Data

US 2011/0134197 A1 Jun. 9, 2011

Related U.S. Application Data

(60) Division of application No. 12/133,857, filed on Jun. 5, 2008, now Pat. No. 8,083,335, which is a continuation of application No. 10/912,937, filed on Aug. 6, 2004, now Pat. No. 7,384,133.

(30) Foreign Application Priority Data

Aug. 8, 2003 (JP) ..... 2003-290827
Aug. 8, 2003 (JP) ..... 2003-290828

(51) Int. Cl.
*B41J 2/175* (2006.01)

(52) U.S. Cl. ..... 347/86; 347/84; 347/85

(58) Field of Classification Search ..... 347/86, 347/85, 84

See application file for complete search history.

(56) References Cited

U.S. PATENT DOCUMENTS 4,928,126 A 5/1990 Asai
5,640,186 A * 6/1997 Swanson et al. ..... 347/86
5,666,146 A * 9/1997 Mochizuki et al. ..... 347/86
5,701,995 A 12/1997 Higuma et al.
6,102,535 A 8/2000 Papenfuhs et al.
6,106,112 A 8/2000 Okubo et al.
6,132,036 A 10/2000 Abe et al.
6,149,256 A 11/2000 McIntyre et al.
6,183,077 B1 2/2001 Hmelar et al.
6,264,314 B1 7/2001 Mochizuki et al.
6,267,474 B1 7/2001 Mochizuki
6,312,115 B1 11/2001 Hara et al.
6,375,316 B1 * 4/2002 Okubo et al. ..... 347/86
6,422,691 B2 7/2002 Kobayashi et al.
6,505,924 B2 1/2003 Shimizu
6,505,926 B1 * 1/2003 Trafton et al. ..... 347/86
6,582,068 B2 6/2003 Ishizawa et al.
6,585,359 B1 7/2003 Gasvoda et al.
6,616,363 B1 9/2003 Guillaume et al.
6,666,551 B2 12/2003 Kobayashi et al.
6,676,251 B1 1/2004 Kamp (Continued)

FOREIGN PATENT DOCUMENTS

CN 1100995 A 4/1995

(Continued)

*Primary Examiner* — Manish S Shah

(74) *Attorney, Agent, or Firm* — Stroock & Stroock & Lavan LLP

(57) ABSTRACT

A second sealing film F2 is thermally bonded onto a leading end portion R1 of an ink lead-out member 32*b* of an ink pack and an annular projecting portion R2 provided on an ink casing 31. Thereby, a gap D produced between the ink lead-out member 32*b* and the ink casing 31 can be closed from outside the ink casing 31. Accordingly, the airtightness of a space S in the ink casing 31 is kept, thus making it possible to raise the pressure in the space S and generate such a force as to crush the ink pack.

7 Claims, 8 Drawing Sheets

U.S. PATENT DOCUMENTS

| | | | | |
|---|---|---|---|---|
| 6,746,111 | B2 | 6/2004 | Thielman et al. | |
| 6,786,581 | B1 | 9/2004 | Shinada et al. | |
| 6,843,558 | B2 | 1/2005 | Seino | |
| 6,854,834 | B2 | 2/2005 | Hara et al. | |
| 6,886,927 | B2 | 5/2005 | Shinada et al. | |
| 6,908,182 | B2 | 6/2005 | Nakazawa et al. | |
| 6,955,422 | B2 * | 10/2005 | Miyazawa et al. | 347/86 |
| 7,011,465 | B2 | 3/2006 | Guillaume et al. | |
| 7,059,795 | B2 | 6/2006 | Guillaume et al. | |
| 2001/0040613 | A1 | 11/2001 | Nakazawa et al. | |
| 2002/0089576 | A1 * | 7/2002 | Ishizawa et al. | 347/86 |
| 2004/0252146 | A1 | 12/2004 | Naka et al. | |
| 2005/0041061 | A1 | 2/2005 | Ishizawa et al. | |
| 2005/0057622 | A1 | 3/2005 | Kimura et al. | |

FOREIGN PATENT DOCUMENTS

| | | | |
|---|---|---|---|
| EP | 0 715 958 | A2 | 6/1996 |
| EP | 0778144 | A | 6/1997 |
| EP | 1348556 | A | 10/2003 |
| JP | 03-260980 | A | 11/1991 |
| JP | 05-016377 | A | 1/1993 |
| JP | 05-219613 | A | 8/1993 |
| JP | 05-318760 | A | 12/1993 |
| JP | 07-125770 | A | 5/1995 |
| JP | 07-304184 | A | 11/1995 |
| JP | 09-109414 | A | 4/1997 |
| JP | 09-174873 | A | 7/1997 |
| JP | 11-070670 | A | 3/1999 |
| JP | 11-157099 | A | 6/1999 |
| JP | 2000-085139 | A | 3/2000 |
| JP | 2000-103079 | A | 4/2000 |
| JP | 2001-162834 | A | 6/2001 |
| JP | 2001-205819 | A | 7/2001 |
| JP | 2001-212973 | A | 8/2001 |
| JP | 2001-301877 | A | 10/2001 |
| JP | 2002-001980 | A | 1/2002 |
| JP | 2002-273909 | A | 9/2002 |
| JP | 2002-540016 | A | 11/2002 |
| JP | 2003-200590 | A | 7/2003 |
| JP | 2004-066488 | A | 3/2004 |

* cited by examiner

LIQUID CONTAINER

CROSS-REFERENCE TO RELATED APPLICATIONS

This application is a divisional application of copending U.S. patent application Ser. No. 12/133,857 filed on Jun. 5, 2008 which is a continuation of U.S. patent application Ser. No. 10/912,937, filed on Aug. 6, 2004, now U.S. Pat. No. 7,384,133 the contents of each of which are hereby incorporated by reference herein.

BACKGROUND OF THE INVENTION

The present invention relates to a liquid container.

As a liquid ejecting apparatus that ejects ink droplets through nozzles of a liquid ejecting head, there is an ink jet printer. A liquid container (ink cartridge) storing a liquid (ink) to be supplied to the liquid ejecting head (print head) is detachably mounted in this ink jet printer. The ink cartridge is made up of a casing and members (e.g., a porous member, an ink containing bag, and a film valve) for holding the ink in the casing. To easily house such members in the casing, the casing normally comprises a body casing and a lid portion.

JP-A-5-16377 discloses an ink cartridge having a bag-like ink pack housed in a casing made up of a body casing and a lid portion. This lid portion is provided with a pair of horns and a pair of claw portions. At the same time, the body casing is provided with hole portions corresponding to the horns and recessed portions corresponding to the claw portions. And, after the ink containing bag is housed in the body casing, the horns of the lid portion are fitted into the hole portions, and the claw portions of the lid portion are engaged into the recessed portions of the body casing. Thus, the lid portion is attached to the body casing, thereby forming the ink container (ink cartridge). With such a configuration, the lid portion can be securely connected to the body casing. Besides, the lid portion can be detached from the body casing by simply releasing the engagement between the claw portions and the recessed portions and then disengaging the horns from the hole portions. Accordingly, the ink containing bag can be replaced, which can reproduce the lid portion and the body casing, thus enabling recycle usage of the ink container.

With the configuration of the ink cartridge of JP-A-5-16377, however, in manufacturing its lid portion or body casing, when a dimensional error occurs between the lid portion and the body casing due to a manufacturing error, the horns or claw portions of the lid portion shift relative to the hole portions or recessed portions of the body casing. This makes it difficult to attach the lid portion to the body casing, thus taking a lot of trouble over the operation of forming the ink cartridge.

Besides, recently, because of an increase in ink flow due to an increase in the print speed and fineness of the printer, an ink jet recording apparatus sometimes adopts the following means. That is, when ink is supplied to a recording head, air is flowed into the ink container, thereby pressurizing the ink containing bag. In this case, when the air is flowed into the ink container to pressurize the ink container bag, the inflow air pressurizes the lid portion from inside the ink container accordingly. Such pressurization bends the lid portion, and the horns or claw portions of the lid portion moves accordingly, so that the lid portion becomes easy to come off the body casing. Thus, there is the problem that the reliability of the ink container will be reduced.

When the ink containing bag is pressurized by flowing the air into the ink container, it is necessary to increase the air pressure between the casing and the ink pack. Consequently, an opening of the casing for attaching the ink pack thereto need be hermetically sealed. As shown in FIG. 7, in an ink cartridge 151 of JP-A-2001-212973, a plug body 155 sealing an opening portion of an ink pack 154 projects to the outside from an opening potion 153 formed in a casing 152. In this state, an O-ring 156 is applied to the opening portion 153, while an engaging member 157 is pushed into the opening portion 153 from outside the casing 152, thereby hermetically attaching the plug body 155 to the opening portion 153.

Accordingly, in the ink cartridge having the bag-like ink pack or the like housed in the casing, a sealing member for improving sealing properties will be required and in addition, the structure of the sealing member will be complicated, thus increasing costs. Otherwise, the number of steps in assembling the apparatus increases in some cases.

The invention has been made to solve the aforesaid problems, and an object thereof is to provide a liquid container capable of maintaining airtightness while reducing the number of components and the number of assembly steps. Besides, another object is to provide a liquid container that can reduce the influence of a manufacturing error caused upon manufacture and has high reliability.

Additionally, the liquid container of the invention can be suitably utilized as an ink cartridge of an ink jet printer including an off-carriage type of ink supply system, but is not limited thereto. For example, the liquid container of the invention is also applicable to a printer of the type that mounts thereto an ink cartridge mounted to a movable carriage disposed in the ink jet printer.

Here, the off-carriage type of ink supply system refers, for example, to a system that has an ink cartridge disposed on the side of a printer body and supplies ink from the ink cartridge via an ink supply tube or an ink replenishment mechanism, directly or via a sub-tank, to a print head mounted on the carriage movable to the body side.

The off-carriage type of ink supply system is suitably utilized in a printer that includes an ink cartridge of large capacity to print large prints and a printer whose size and thickness is reduced by mounting no ink cartridge on a carriage for a reduction in the size of the carriage.

SUMMARY OF THE INVENTION

The liquid container of the invention is a liquid container comprising a liquid containing bag that has a flexible portion including a lead-out member for leading a liquid out to the outside, and a casing, housing the liquid containing bag therein, that includes a space for pressurizing the liquid containing bag and also that includes an opening portion for outwardly exposing a leading end portion of the lead-out member of the liquid containing bag, wherein a gap formed between the opening portion of the casing and the lead-out member is sealed with a sealing member from outside the casing.

According to this invention, the gap produced between the lead-out member provided on the liquid containing bag and the opening portion of the casing into which the lead-out member is inserted can be closed from outside the casing. Accordingly, the airtightness of the liquid container is kept, thus making it possible to raise the pressure in a space and generate such a force as to crush the liquid containing bag. Besides, a member for closing the gap produced between the lead-out member provided on the liquid containing bag and the opening portion of the casing into which the lead-out member is inserted need not be inserted inside the casing.

Consequently, the number of component assembly steps can be reduced, while the number of components can be reduced.

In this liquid container, the sealing member has a shape and size capable of sealing at least the gap.

According to this invention, the sealing member can have any size and shape that covers at least the gap, so that there is no need for a component specialized in the size and shape of the gap. Accordingly, component costs can be reduced.

In this liquid container, the sealing member is bonded to the leading end portion of the lead-out member and to an annular projecting portion formed along an opening edge of the opening portion through which is exposed the leading end portion of the lead-out member.

According to this invention, it becomes easier to bond the sealing member.

In this liquid container, second projecting portions are formed on the casing so as to surround the annular projecting portion, and the sealing member is bonded to the second projecting portions together with the leading end portion of the lead-out member and the annular projecting portion.

According to this invention, since the sealing member is bonded even to the second projecting portions, the sealing member becomes difficult to come off the annular projecting portion.

In this liquid container, the sealing member, lead-out member, and casing are all of the same material, and the sealing member is bonded by heat welding.

According to this invention, the gap between the lead-out member provided on the liquid containing bag and the opening portion of the casing into which the lead-out member is inserted can be sealed with the sealing member by simply heat welding of the sealing member from outside the liquid container after the liquid containing bag is housed in the casing. Accordingly, it is possible to reduce the number of component assembly steps.

In this liquid container, the gap between the opening portion of the casing and the lead-out member is sealed with the sealing member so that an outer surface of the casing and an end portion of the lead-out member become substantially flush with each other.

According to this invention, the bonding of a film by heat welding can be easily and reliably performed without deposition failure or the like.

In this liquid container, a liquid lead-out opening is formed at the end portion of the lead-out member, and the opening of the lead-out member and the gap are sealed with the single sealing member bonded to the outer surface of the casing. According to this invention, the sealing of the opening of the lead-out member and the sealing of the gap between the opening portion of the casing and the lead-out member can be performed in the same step. Furthermore, the number of components can be reduced.

The liquid container of the invention is a liquid container comprising a first casing having an opening portion, and a second casing that is attached to the first casing and closes the opening portion of the first casing, wherein the first casing includes at least one first engaging means, and the second casing includes at least one second engaging means that engages the first engaging means, the configuration being such that the first engaging means includes a first guide portion that guides the second engaging means when the first engaging means engages the second engaging means, and such that the second engaging means has flexibility.

According thereto, when the second casing is attached to the first casing, the second engaging means is guided by the first guide portion, thereby enabling smooth attachment. Besides, on this occasion, since having flexibility, the second engaging means can bends slightly upon attachment. Thereby, even when the second engaging means, for example, is formed slightly shifted widthwise or lengthwise of the first casing relative to the first engaging means due to a manufacturing error caused upon manufacture of the second engaging means, the second engaging means can engage the first engaging means. Accordingly, even when the first casing or the second casing is formed slightly larger or smaller than each other, the second casing can be attached to the first casing.

This liquid container is configured such that the first guide portion supports the second engaging means when the first engaging means and the second engaging means are engaged together.

According thereto, it is configured that the first guide portion supports the second engaging means when the first engaging means and the second engaging means are engaged together. With such a configuration, the second engaging means can be stably engaged by the first engaging means, so that the second casing can be stably attached to the first casing.

The second engaging means of this liquid container has at its leading end portion a claw portion (preferably, like a hook) that engages the first engaging portion to restrict the movement of the second engaging means, and the claw portion includes a second guide portion that guides the claw portion when the claw portion engages the first engaging means.

According thereto, the second engaging means has at its leading end portion a claw portion that engages the first engaging portion to restrict the movement of the second engaging means. This claw portion includes a second guide portion that guides the claw portion when the claw portion engages the first engaging means. With such a configuration, when the second casing is attached to the first casing, the second engaging means is guided by the second guide portion. Thereby, the second casing can be smoothly attached to the first casing. Besides, the claw portion engages the first engaging means, thereby making it possible to restrict the movement of the second casing. As a result, the second casing can be adhered and also fixed to the first casing.

The second engaging means of this liquid container includes a third guide portion that guides the second engaging means when the claw portion engages the first engaging means.

According thereto, when the second casing is attached to the first casing, the second engaging means is guided by the third guide portion. Thereby, the second casing can be smoothly attached to the first casing.

In this liquid container, the third guide portion is formed so as to be opposed directly to the first guide portion when the claw portion is engaged with the first engaging means, and the configuration is such that the first guide portion supports the second engaging means via the third guide portion when the third guide portion abuts the first guide portion.

According thereto, for example, when air flows into the liquid container and the second casing is thereby pressurized from inside thereof and then bulges, even when the second engaging means moves in response thereto, the third guide portion abuts the first guide portion, thus restricting the second engaging means from moving. Thereby, the first engaging means and the second engaging means can be prevented from coming off each other. As a result, the second casing can be prevented from coming off the first casing, so that the reliability of the liquid container housing the liquid containing bag can be improved.

In this liquid container, the second engaging means is formed to project from the second casing, and the first engaging means is formed inside the opening portion into which the second engaging means can be inserted, and the configuration is such that when the second engaging means and the first engaging means are engaged together, the engagement portion is covered with an outer wall of the first casing.

According thereto, the second engaging means is formed to project from the second casing, and the first engaging means is formed inside the opening portion into which the second engaging means can be inserted. Furthermore, when the second engaging means and the first engaging means are engaged together, the engagement portion is covered with an outer wall of the first casing. Thereby, since this engagement portion will not be subjected to the influence from outside, for example, the engagement portion can be prevented from coming out of engagement due to an impact from the outside such as caused by a collision. Besides, the engagement portion is thus covered, thereby enabling simplification of the outer appearance.

In this liquid container, the first easing has inside thereof a frame body that defines a space for housing a liquid containing bag, and the first engaging means is formed between the frame body and the outer wall of the first casing.

According thereto, the first casing has inside thereof a frame body that defines a space for housing a liquid containing bag, and the first engaging means is formed between the frame body and the outer wall of the first casing. Accordingly, no obstacle such as a projection forming the first engaging means exists in the space for housing the liquid containing bag. Thereby, it is possible to reduce the problem that such an obstacle has an undesired impact on the liquid containing bag when the first casing and the second casing are engaged together and like problem. Furthermore, when the first casing is bonded to the second casing, the second engaging means projecting from the second casing will not abut the liquid containing bag. Therefore, the liquid containing bag can be prevented from accidentally contacting the second engaging means and damaging the liquid containing bag.

The present disclosure relates to the subject matter contained in Japanese patent application Nos. 2003-290827 and 2003-290828; (filed on Aug. 8, 2003), each of which is expressly incorporated herein by reference in its entirety.

DESCRIPTION OF THE PREFERRED EMBODIMENT

An embodiment in which the invention is embodied will hereinafter be described according to FIGS. 1 to 6 and 8 to 11.

Figure 1:
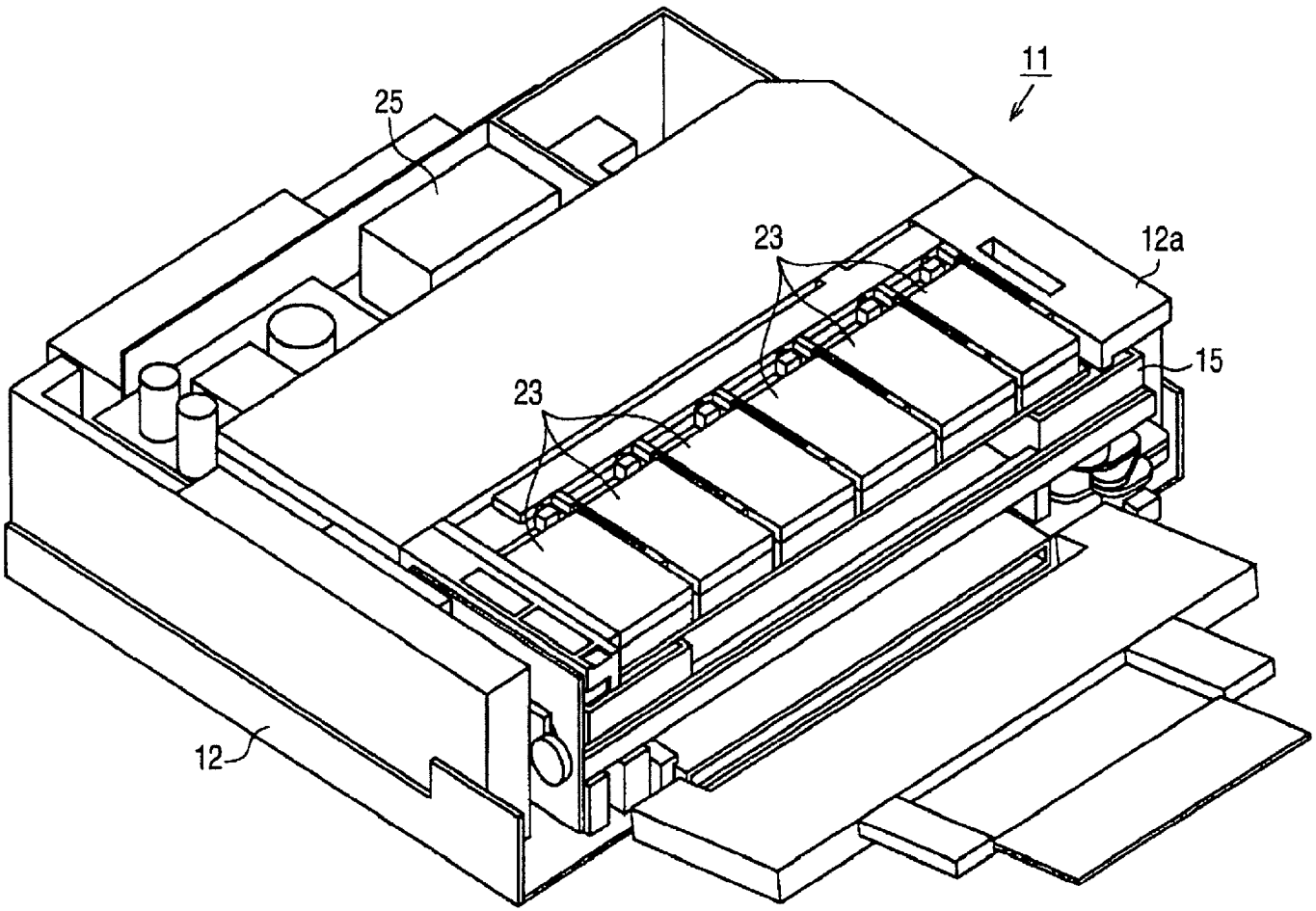
FIG. 1 is a perspective view of a printer of this embodiment.
Figure 2:
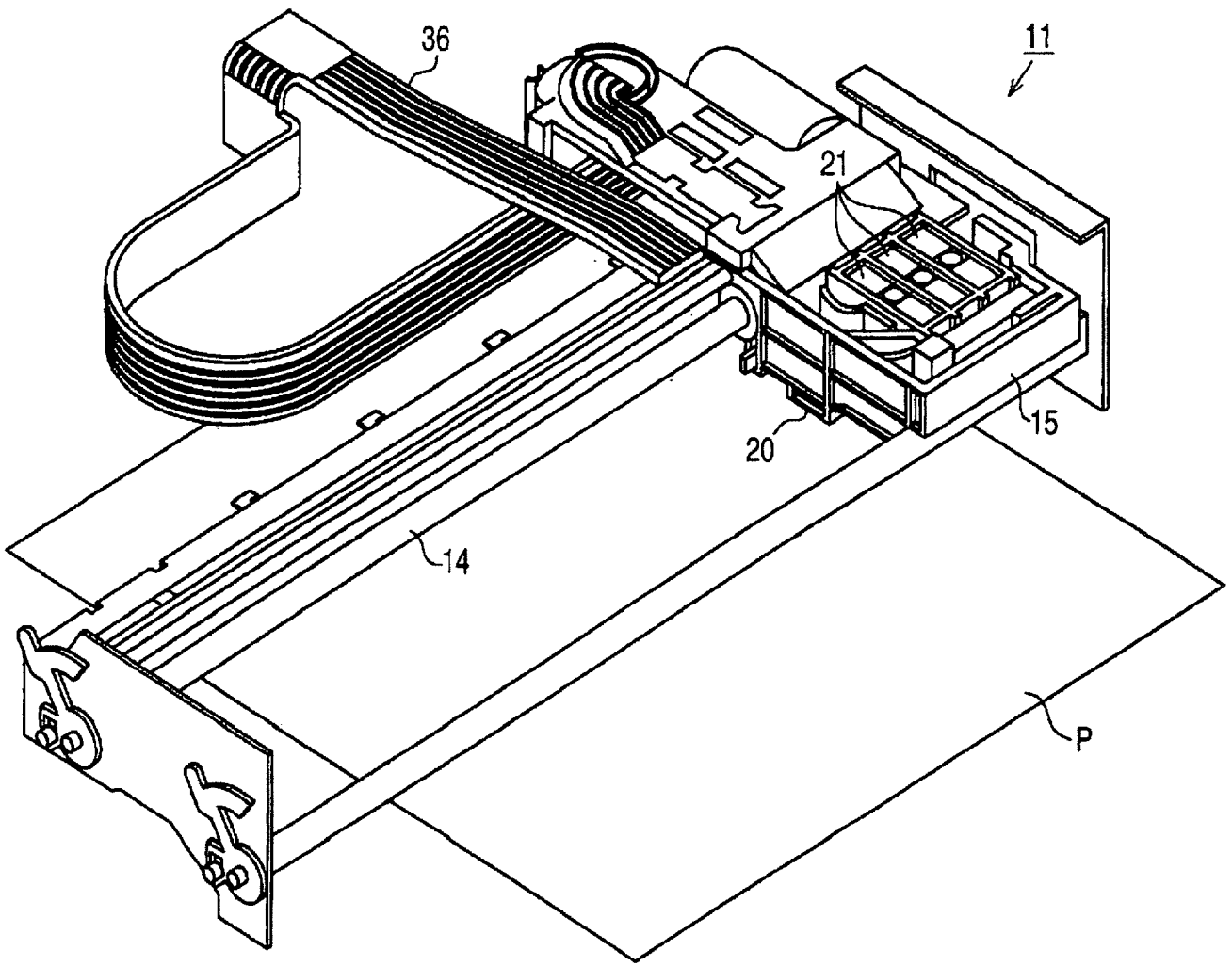
FIG. 2 is an exploded perspective view of the printer.
Figure 3:
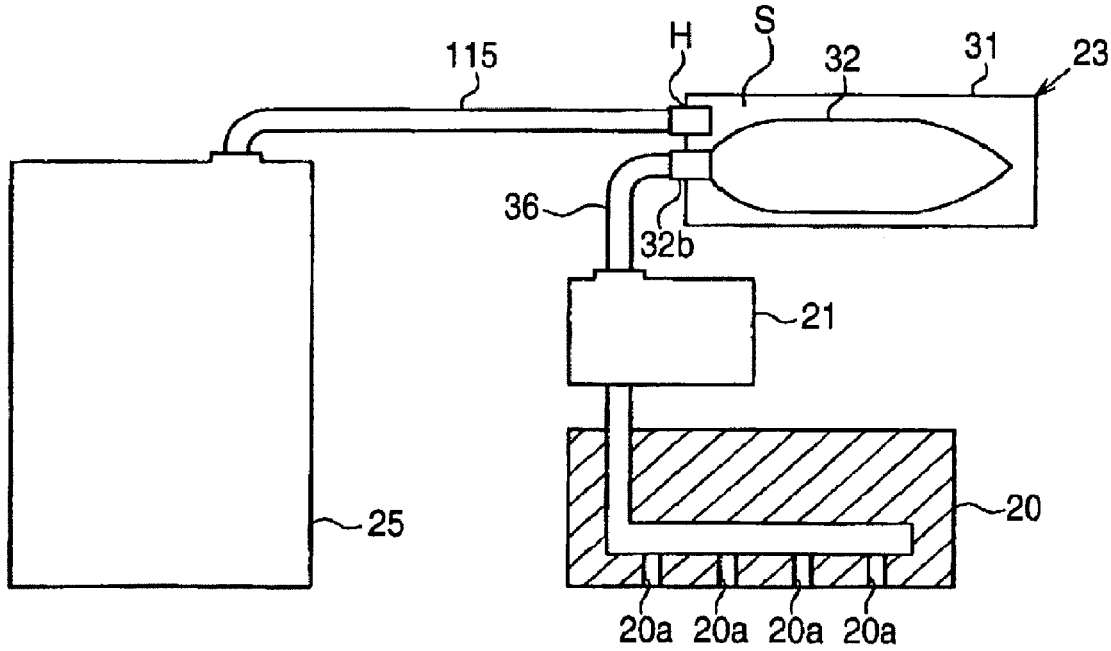
FIG. 3 is a schematic diagram to illustrate ink supply of the embodiment.

FIG. 1 is a perspective view to illustrate an outline of a printer of this embodiment. FIG. 2 is a perspective view to illustrate an internal configuration of the printer of this embodiment. FIG. 3 is a schematic diagram to illustrate ink supply of this embodiment.

As shown in FIG. 1, the printer 11, serving as the liquid ejecting apparatus, of this embodiment has a frame 12. And, as shown in FIG. 2, the frame 12 has therein a guide shaft 14, a carriage 15, a recording head 20 serving as the liquid ejecting head, valve units 21, ink cartridges 23 (see FIG. 1) serving as the liquid containers, a pressure pump 25 (see FIG. 1).

As shown in FIG. 1, the frame 12 is a substantially rectangular-shaped box, at the front of which a cartridge holder 12*a* is formed.

As shown in FIG. 2, the guide shaft 14, formed as a rod, is disposed in the frame 12 in spanning relation thereto. Additionally, the direction in which the guide shaft 14 spans the frame 12 is referred to in this embodiment as a main scan direction. The carriage 15, having the aforesaid guide shaft 14 inserted therethrough so as to be movable relative to the guide shaft 15, is reciprocally movable in the main scan direction. And, the carriage 15 is connected via a timing belt (not shown) to a carriage motor (not shown). The carriage motor, supported on the frame 12, is driven to thereby drive the carriage 15 via the timing belt, so that the carriage 15 is reciprocally moved along the guide shaft 14, i.e., in the main scan direction.

The recording head 20 disposed on the underside of the carriage 15, having a plurality of nozzles (20*a*) for ejecting ink that serves as the liquid, ejects ink droplets onto a print medium such as recording paper, thereby performing recording of print data such as images and characters. The valve units 21, mounted on the carriage 15, are configured to supply temporarily reserved ink, with its pressure adjusted, to the aforesaid recording head 20.

Additionally, in this embodiment, the valve units 21 are configured such that two types of ink per unit, with their pressure adjusted, can be each separately supplied to the recording head 20. And, in this embodiment, there are provided three valve units 21 in total, which correspond to six colors of ink (black, yellow, magenta, cyan, light magenta, and light cyan).

Additionally, a platen (not shown) is disposed below the recording head 20. This platen serves to support a recording medium P serving as a target that is fed by paper feed means (not shown) in a sub-scan direction perpendicular to the main scan direction.

As shown in FIG. 1, the ink cartridges 23 are detachably housed in the aforesaid cartridge holder 12*a*, and there are provided six ink cartridges 23 so as to correspond to the aforesaid ink colors.

As shown in FIG. 3, these ink cartridges 23 each have an ink pack 32 serving as the liquid containing bag in a respective cartridge casing 31 thereof. And, the ink pack 32, provided with an ink supply member 32*b* that is the liquid lead-out portion, is housed in the cartridge casing 31 of the ink cartridge 23. And, the cartridge casing 31 is provided with an air lead-in port H so as to communicate with a gap S formed between the cartridge casing 31 and the ink pack 32.

With such a configuration, air is flowed in through the air lead-in port H, thereby making it possible to raise the pressure in the gap S and generate such a force as to depress the ink pack 32.

At the same time, as shown in FIG. 3, the ink supply member 32*b* of the ink pack 32 is connected to the valve unit 21 via an ink supply tube 36 disposed per ink color. As aforesaid, this valve unit 21 is connected to the recording head 20.

With such a configuration, ink in the ink pack 32 is arranged to be supplied to the valve unit 21 via the ink supply tube 36.

Additionally, FIG. 3 illustrates only one of the six ink cartridges 23, wherein since the remaining five ink cartridges 23 have the same structure, the illustration thereof is omitted.

Besides, as shown in FIG. 1, the air pressure pump 25 is fixed to the back face side of the frame 12. And, the air pressure pump 25 is capable of sucking in atmospheric air and discharging the sucked-in atmospheric air as pressurized air. Besides, the air pressure pump 25 is connected via six air tubes 115 (see FIG. 3) to the corresponding air lead-in ports H of the ink cartridges 23.

With such a configuration, the air pressurized in the air pressure pump 25 is led into the gap S of the ink cartridge 23 via the air tube 115.

Accordingly, for example, when the pressurized air is flowed into the gap S from the air pressure pump 25 to pressurize the ink pack 32 of each ink cartridge 23, the ink in this ink pack 32 is supplied to the valve unit 21. And, the ink temporarily reserved in the valve unit 21, with its pressure adjusted, is supplied to the recording head 20. And, the printer 11 is configured such that based on image data, the carriage 15 is moved in the main scan direction while the recording medium P being moved by the paper feed means in the sub-scan direction, thus ejecting the ink from the recording head 20, thereby performing printing on the recording medium P.

Figure 4:
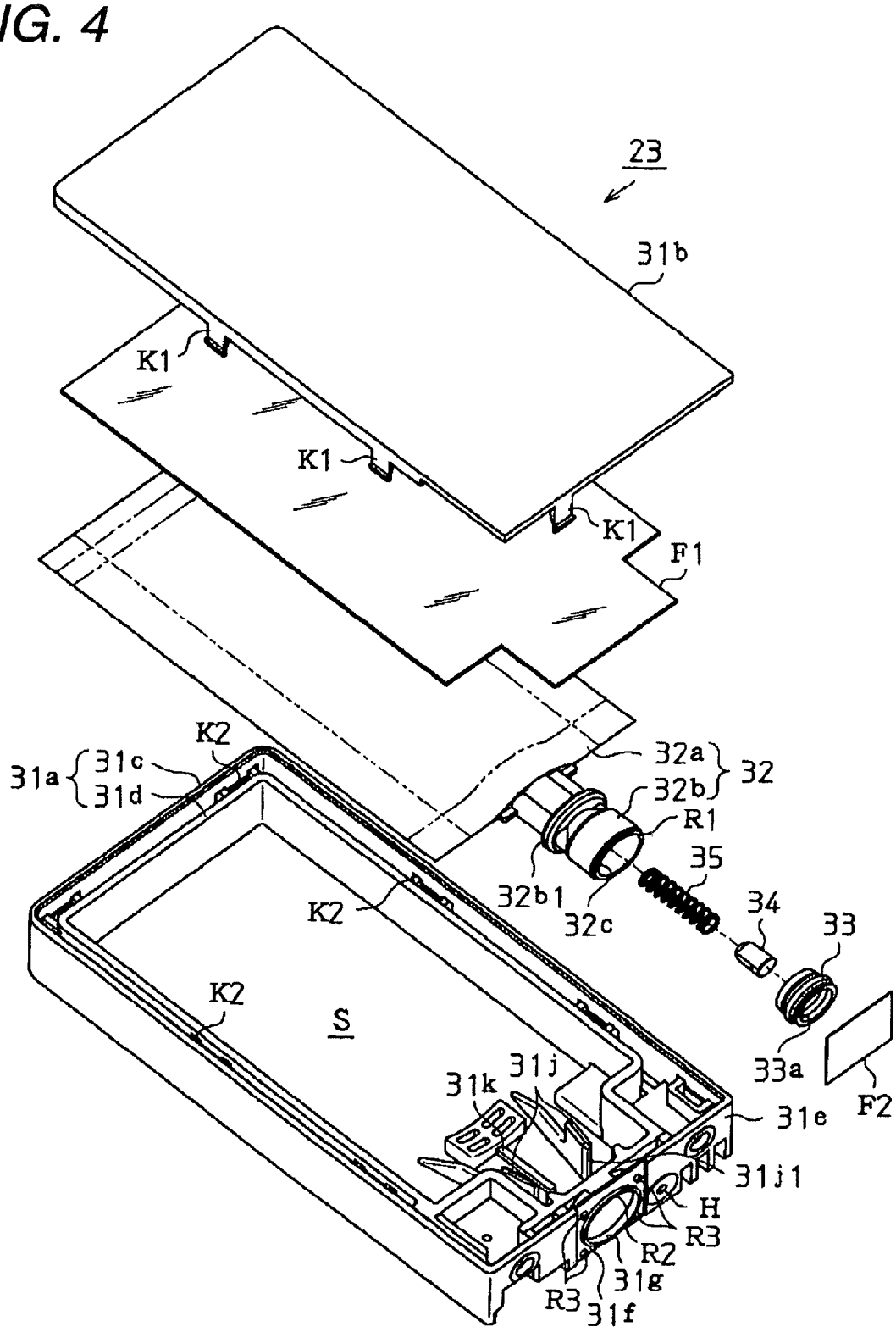
FIG. 4 is an exploded perspective view of an ink cartridge of the embodiment.
Figure 5:
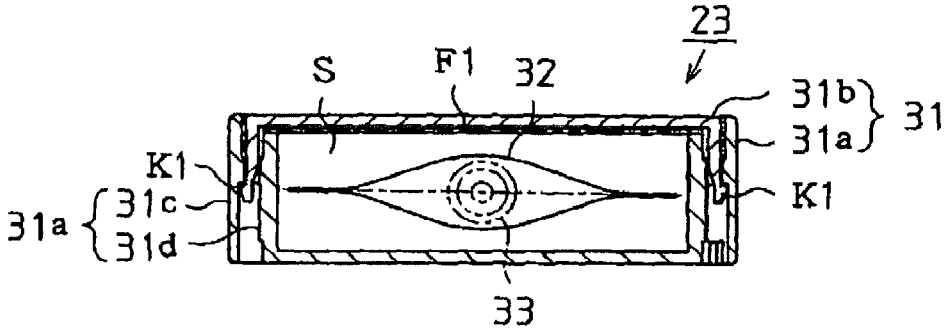
FIG. 5 is a sectional view of the ink cartridge.

As shown in FIG. 4, the ink cartridge 23 includes a body casing 31*a*, a top casing 31*b*, and the ink pack 32 serving as the liquid containing bag. And, as shown in FIG. 5, the body casing 31*a* and the top casing 31*b* configure the ink casing 31 serving as the casing, and the ink pack 32 is housed in the casing. Additionally, FIG. 4 illustrates only one of the six ink cartridges 23, wherein since the remaining five ink cartridges 23 have the same structure, the illustration thereof is omitted.

As shown in FIG. 4, the ink pack 32 includes an ink bag 32*a* that is the flexible portion, the ink lead-out member 32*b* serving as the liquid lead-out member, and a supply port member 33. The ink bag 32*a* is formed of a material having flexibility and gas barrier properties. For example, two aluminum laminate films, each having a configuration in which an aluminum material is sandwiched between a nylon film on the outside and a polypropylene film on the inside, are superposed one upon the other and bonded around the periphery by a method such as thermal deposition, thereby forming the ink bag 32*a*. The ink bag 32*a* may be formed by superposing together two laminate films having flexibility that are each formed by depositing aluminum on a polyethylene film having gas barrier properties.

The ink lead-out member 32*b*, formed from polypropylene for example, is attached to the ink bag 32*a* by a method such as thermal bonding (heat welding). Particularly, in forming the aforesaid ink bag 32*a*, after being bonded together at three sides by thermal bonding, the two aluminum laminate films superposed are thermally bonded together at the remaining one side with the ink lead-out member 32*b* disposed at its central portion, thereby forming the ink pack 32. It is preferable, from the viewpoint of performing the thermal bonding, that at least a portion in which the ink lead-out member 32*b* and the ink bag 32*a* are in contact with each other is formed of the same quality material.

The ink in the ink bag 32*a* is stored therein in a degassed state. The ink lead-out member 32*b* is formed in a substantially cylindrical shape and the inside thereof forms an ink lead-out port 32*c*. The ink stored in the ink bag 32*a* is taken out via this ink lead-out port 32*c*. Besides, the ink lead-out port 32*c* is provided with a valve mechanism that is opened only at the time of ink supply, and thus configured to prevent leakage of the ink in the ink bag 32*a*. A spring seat 34 and a coil spring 35 are disposed in the valve mechanism of the ink lead-out port 32*c*, more particularly, in the ink lead-out port 32*c* of the ink lead-out member 32*b* and inwardly from the supply port member 33. The coil spring 35 urges the spring seat 34 to the supply port member 33 side, whereby the spring seat 34 closes a supply port 33*a* of the supply port member 33. When the ink cartridge 23 is placed in the cartridge holder 12*a*, an ink supply needle formed on the liquid ejecting apparatus passes through the inside of the supply port member 33 and ink lead-out member 32*b* and presses the spring seat 39 to the ink bag 32*a* side against the resilient force of the coil spring 35. When the spring seat 34 is pressed and separated from the supply port member 33, the ink in the in bag 32*a* flows outside through the gap between the supply port member 33 and the spring seat 34.

Accordingly, the configuration is as follows. That is, in the state where the liquid ejecting apparatus is not mounted with the ink cartridge 23, the spring seat 34 seals the supply port 33*a*. At the same time, when the liquid ejecting apparatus is mounted with the ink cartridge 23, the ink supply needle formed on the liquid ejecting apparatus pushes up the spring seat 34 to provide the state in which the ink is ready to be supplied. In this case, it is easy to handle the ink pack when the ink casing 31 is mounted with the ink pack 32 after the ink is injected into the ink pack 32.

Figure 6:
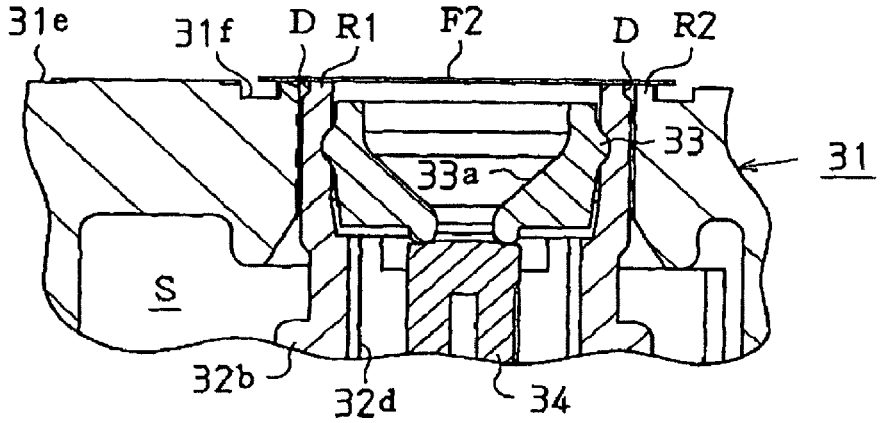
FIG. 6 is a sectional view of a main portion of the ink cartridge.
Figure 7:
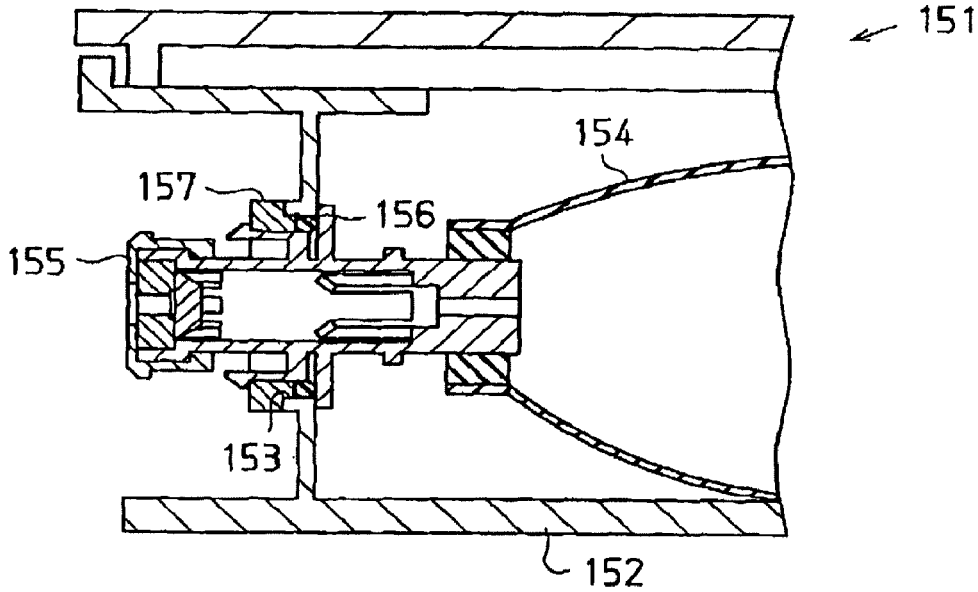
FIG. 7 is a sectional view of a conventional ink cartridge.

The supply port member 33 disposed inside the ink lead-out port 32*c* of the ink lead-out member 32*b* is formed of an elastic material such as an elastomer. The supply port member 33, having a substantially cylindrical shape, is open at the top and bottom and, as shown in FIG. 6, is fixed in position with the outer peripheral surface thereof in an elastic contact with the inner wall surface of the ink lead-out port 32*c* of the ink lead-out member 32*b*. The inside of the supply port member 33 forms the funnel-like supply port 33*a* and makes an elastic contact with the outer periphery of the liquid supply needle formed on the liquid ejecting apparatus. And, a liquid lead-in port of the liquid supply needle inserted in the supply port 33*a* is positioned in a flow path 32*d* of the ink lead-out member 32*b*, thereby supplying the ink stored in the ink bag 32*a* to the liquid ejecting apparatus. Additionally, an opening end of the supply port member 33 is retracted inwardly from a leading end portion R1 of the ink lead-out member 32*b* (ink lead-out port 32*c*).

The body casing 31*a* is made up of an outer casing 31*c* and an inner casing 31*d*, each of which is formed from polypropylene for example. The outer casing 31*c*, having a substantially rectangular shape, is formed in a box that is open to the top side. The inner casing 31*d*, which is one size smaller than the outer casing 31*c* and has a shape similar to the ink pack 32, restricts the ink pack 32 from moving in response to the movement of the ink casing 31. The top casing 31*b*, made up of a substantially quadrangular plate-like body that covers the top face of the body casing 31*a*, is formed from polypropylene for example. The top casing 31*b*, having retaining pieces K1 provided at predetermined places thereof, is configured such that the retaining pieces K1 engage engaging members K2 formed between the outer casing 31*c* and the inner casing 31*d* when the top casing 31*b* covers the top face of the body casing 31*a*.

A square-shaped supply port attachment portion 31*f* is formed in the center of a front face 31*e* of the body casing 31*a*. The supply port attachment portion 31*f* is provided with an opening portion 31*g* communicating with the aforesaid inner casing 31*d*. And, on the opening edge of the opening portion 31*g*, an annular projecting portion R2 is formed along this opening edge so as to project outwardly of the ink casing 31. Besides, column-like independent projecting portions R3 serving as the second projecting portions are formed at four corners of the supply port attachment portion 31*f* so as to project the same amount as the aforesaid annular projecting portion R2 outwardly of the ink casing 31.

The air lead-in port H is formed on one side of the aforesaid supply port attachment portion 31*f*. The air lead-in port H provides communication between the outside of the body casing 31*a* and the inside of the inner casing 31*d*. When being housed in the aforesaid ink casing 31, the ink pack 32 is housed in the inner casing 31*d* so that the ink lead-out member 32*b* of the ink pack 32 is exposed outward from inside the aforesaid opening portion 31*g*. On this occasion, as shown in FIG. 6, the ink lead-out member 32*b* exposed from the opening portion 31*g* is housed so that the leading end portion R1 projects to a position flush with the aforesaid annular projecting portion R2.

When the ink pack 32 is housed in the inner casing 31*d*, it is configured that a first sealing film F1 (see FIG. 4) made from polypropylene is thermally bonded on a top face 31*d*1 of the inner casing 31*d*. Besides, it is configured that a second sealing film F2 made from polypropylene serving as the sealing member is thermally bonded on the supply port attachment portion 31*f* of the ink casing 31. To be specific, the second sealing film F2 is thermally bonded onto the annular projecting portion R2, formed on the opening edge of the opening portion 31*g*, that projects outward from the supply port attachment portion 31*f* and onto the leading end portion R1 of the ink lead-out member 32*b*, and also thermally bonded onto each independent projection R3. From the viewpoint of thermal bonding (heat welding), preferably, a bonding surface of the film F1 and a bonding surface of the ink casing 31 are formed of the same quality material, and a bonding surface of the film F2 and a bonding surface of the ink casing 31 are formed of the same quality material. In this connection, the film F2 may have two or more layers made of different materials.

Accordingly, when the second sealing film F2 is thermally bonded onto the annular projecting portion R2 and the leading end portion R1 of the ink lead-out member 32*b*, a gap between the opening portion 31*g* and the ink lead-out member 32*b* is sealed with this second sealing film F2. As a result, a space S formed by the inner casing 31 housing the ink pack 32 and the sealing film is placed in a sealed state except the aforesaid air lead-in port H. Accordingly, because the inner casing 31*d* is maintained airtight, the air supplied through the air lead-in port H from the pressure pump 25 (see FIG. 1) supported on the aforesaid frame 12 will pressurize the ink pack 32 housed in the space S.

Besides, since the second sealing film F2 is thermally bonded onto the leading end portion R1 of the ink lead-out member 32*b*, the ink lead-out port 32*c* of the ink lead-out member 32*b* is also sealed, so that the inside of the ink pack is cut off from the outside. And, the second sealing film F2 is thermally bonded on the annular projecting portion R2, thereby sealing the ink lead-out port 32*c* of the ink lead-out member 32*b*. Therefore, there is not even such a problem that a projection is inserted from the outside to release the spring seat 34, thus taking air bubbles into the ink pack. Furthermore, since the second sealing film F2 is thermally bonded on the independent projecting portions R3 all around the annular projecting portion R2, it prevents the second sealing film F2 from pealing off the annular projecting portion R2 as some force acts on the second sealing film F2.

Furthermore, two ink lead-out member fixing ribs 31*j* are formed on the body casing 31*a* so as to sandwich the ink lead-out member 32*b* therebetween. End portions 31*j*1 of the ink lead-out member fixing ribs 31*j* abut an annular projecting portion 32*b*1 formed as a disk around the outer periphery of the ink lead-out member 32*b*, thus fixing the ink lead-out member 32*b* to the body casing 31*a*. This restricts the ink lead-out member 32*b* from moving to the inside of the body casing 31*a* upon thermal bonding.

Additionally, an anti-rotation member 31*k* is a projection that engages a recessed portion (not shown) formed in the annular projecting portion 32*b*1 of the ink lead-out member 32*b*. The anti-rotation member 31*k* restricts the ink pack from moving in a rotational direction, thus locating the ink pack at a predetermined position.

Figure 8:
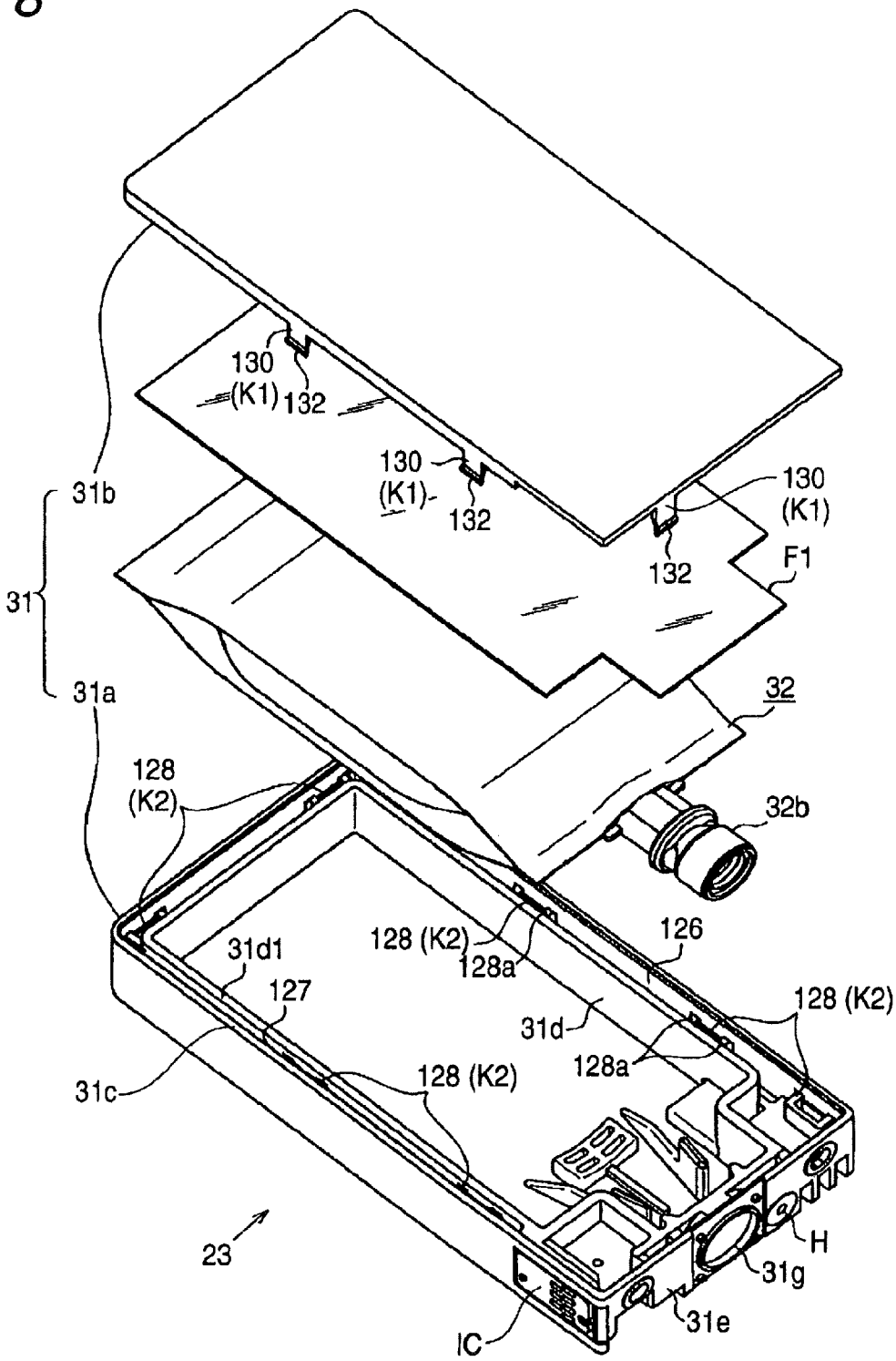
FIG. 8 is an exploded perspective view to illustrate a configuration of the ink cartridge of the embodiment.

As shown in FIGS. 4 and 8, in this embodiment, the aforesaid inner casing 31*d* is disposed spaced a slight distance away from an inner wall surface 126 of the outer casing 31*c*. And, such a distance forms a groove portion between an outer wall surface 127 of the inner casing 31*d* and the inner wall surface 126 of the outer casing 31*c*. Frame-like first engaging portions K2 (128) serving as the first engaging means are formed in this groove portion so that their top faces (upward) are open.

On the other hand, the lid portion 31*b*, formed as a plate, has a size capable of covering the aforesaid opening portion of the outer casing 31*c*. Plate-like second engaging portions K1 (130) serving as the second engaging means are formed on and project downward from the edge of this lid portion 31*b*. And, a plurality of these second engaging portions K1 (130) are formed so as to correspond to the aforesaid first engaging portions K2 (128). Furthermore, the second engaging portions K1 (130) are configured to have a size capable of engaging the aforesaid first engaging portions K2 (128). And, it is configured that the cartridge casing 31 is formed when these second engaging portion K1 (130) of the lid portion 31*b* are engaged with the first engaging portions K2 (128) and this lid portion 31*b* is attached to the outer casing 31*c*.

Thus, the first engaging portions K2 (128) are formed in the aforesaid groove portion, whereby no obstacles such as the projections forming the first engaging portions K2 (128) and the second engaging portions K1 (130) exist in the space for housing the ink pack (in the inner casing 31*d*). Thereby, it is possible to reduce the problem that such obstacles have an undesired impact on the ink pack 32 when the outer casing 31*c* and the lid portion 31*b* are engaged together and like problem.

Additionally, the air lead-in port H communicates directly with the space (the inside of the inner casing 31*d*) S for housing the ink pack 32 without via the groove portion in which the first engaging portions K2 (128) are provided.

A description will now be given of an operation of the printer 11 configured as aforesaid that is effected upon ink supply and printing.

As shown in FIG. 1, the ink cartridge 23 per color is slid toward the backside in the sub-scan direction relative to the cartridge holder 12*a*, whereby the ink cartridge 23 of each color is set in the cartridge holder 12*a*. When the ink cartridge 23 is set, the ink supply needle provided on the cartridge holder 12*a* breaks through the second sealing film F2 and is connected to the ink lead-out member 32*b*. The ink supply needle is connected to the valve unit 21 via the ink supply tube 36. Accordingly, the ink in the ink pack 32 is supplied to the valve unit 21 and then, with the ink pressure adjusted, is supplied to the recording head 20.

Simultaneously therewith, an air lead-in member disposed in the cartridge holder 12*a* is connected to the air lead-in port H of the ink cartridge 23 (body casing 31*a*). The air lead-in member is connected to the pressure pump 25 via an air lead-in tube. Accordingly, the pressurized air can be led into the space S for housing the ink pack 32 by the pressure pump 25. On this occasion, the opening portion of the inner casing 31*d* is sealed with the first sealing film F1, and the gap D between the opening portion 31*g* and the ink lead-out member 32*b* is sealed with the second sealing film F2. Accordingly, the air supplied into the inner casing 31*d* through the air lead-in port H will not leak outside. As a result, the ink pack 32 can be controlled in pressure with good accuracy.

Thereby, when the pressurized air supplied from the pressure pump 25 pressurizes the ink pack 32 of each ink cartridge 23, the ink in the ink pack 32 is supplied to the aforesaid valve unit 21. And, the ink temporarily reserved in the valve unit 21, with its pressure adjusted, is supplied to the recording head 20.

And, based on image data, the carriage 15 is moved in the main scan direction while the recording medium P being moved in the sub-scan direction by the paper feed mechanism, thus ejecting the ink from the recording head 20, thereby making it possible to perform printing on the recording medium P.

According to the aforesaid embodiment, the following advantageous effects can be obtained.

(1) In the aforesaid embodiment, the second sealing film F2 is thermally bonded onto the annular projecting portion R2 formed on the opening edge of the opening portion 31*g* and the leading end portion R1 of the ink lead-out member 32*b*, and also thermally bonded onto each independent projection R3. Therefore, the gap D between the opening portion 31*g* and the ink lead-out member 32*b* can be easily sealed with this second sealing film F2. Accordingly, the space S formed by the inner casing for housing the ink pack 32 and the sealing film is reliably maintained airtight when the air lead-in port H is connected to the air lead-in tube. As a result, airtightness is kept, thereby making it possible to raise the pressure in the space S and generate such a force as to crush the ink pack 32.

(2) In the aforesaid embodiment, the gap D between the opening portion 31*g* and the ink lead-out member 32*b* is sealed with the second sealing film F2. Therefore, a special member for closing the gap D need not be assembled from inside the ink casing 31 as has been conventional. Consequently, the number of component assembly steps can be reduced.

(3) In the aforesaid embodiment, the second sealing film F2 simultaneously seals the ink lead-out port 32*c* of the ink lead-out member 32*b*. Therefore, since the ink in the ink pack 32 is maintained airtight, the ink cartridge 23 that is not put to use can be stored for a long period.

(4) In the aforesaid embodiment, the independent projecting portions R3 all around the annular projecting portion R2 are formed, and the second sealing film F2 is thermally bonded onto the independent projecting portions R3. Accordingly, even when some force acts on the second sealing film F2, the second sealing film F2 is bonded on the independent projecting portions R3, thus enabling the second sealing film F2 to become difficult to peel off the annular projecting portion R2.

(5) In the aforesaid embodiment, the second sealing film F2 can have any size and shape that seals at least the gap D between the opening portion 31*g* and the ink lead-out member 32*b*, so that there is no need for a component specialized in the gap D. Consequently, component costs can be reduced.

(6) In the aforesaid embodiment, the gap between the opening portion 31*g* of the body casing 31*a* and the ink lead-out member 32*b* is sealed with the second sealing film F2 so that the outer surface of the body casing 31*a* and the end portion of the ink lead-out member 32*b* become substantially flush with each other. Consequently, it is possible to easily and reliably perform the thermal bonding.

(7) In the aforesaid embodiment, the gap between the ink lead-out member 32*b* and the ink lead-out port 32*c* and the gap between the opening portion 31*g* of the body casing 31*a* and the ink lead-out member 32*b* are sealed with the second sealing film F2. Consequently, the thermal bonding can be easily and reliably performed. Besides, the sealing of the ink lead-out port 32*c* of the ink lead-out member 32*b* and the sealing of the gap between the opening portion 31*g* of the body casing 31*a* and the ink lead-out member 32*b* can be performed in the same step.

Additionally, the aforesaid embodiment may be modified as follows.

In the aforesaid embodiment, the ink supply needle provided on the cartridge holder 12*a* breaks through the second sealing film F2 and is connected to the ink lead-out member 32*b*. A cross-cut, an X-shaped cut, or like cut, or a hole may be made in the second sealing film F2 so that the second sealing film F2 can be easily broken through in this case.

In the aforesaid embodiment, one annular projecting portion R2 is provided on the front face 31*e* of the ink casing 31. Alternatively, two or more annular projections may be provided. Thereby, the second sealing film F2 can be more strongly thermally bonded thereon.

In the aforesaid embodiment, the ink casing 31, supply port member 33, and second sealing film F2 are formed from polypropylene. However, they can be formed from any material that can be thermally bonded. For example, the material may be polyethylene.

In the aforesaid embodiment, the second sealing film F2 is formed to have a square shape and the same size as the supply port attachment portion 31*f*. However, the second sealing film F2 can have any size and shape capable of closing at least the gap D. For example, the second sealing film F2 may have a circular shape whose diameter is of the same size as one side of the supply port attachment portion 31*f*, and may have an annular shape that covers the gap D.

In the aforesaid embodiment, the second sealing film F2 is a film. Alternatively, it may be an adhesive tape for example.

In the aforesaid embodiment, the supply port member 33 disposed in the ink lead-out member 32*b* is open. Alternatively, the ink cartridge may be configured as follows. One of the openings of the supply port 33*a* is sealed with the same material as that of the supply port 33*a*, and when the liquid ejecting apparatus is mounted with the ink cartridge, the ink supply needle formed on the liquid ejecting apparatus passes through the recessed portion formed in the center of the supply port 33*a* sealed, thereby making the ink ready to be supplied. In this case, it is easy to handle the ink pack when the ink casing 31 is mounted with the ink pack 32 after the ink is inserted into the ink pack 32. Besides, since the supply port 33*a* is sealed with the second sealing film F2, there is not even such a problem that the supply port 33*a* is opened as a projection is inserted thereinto from the outside, thus taking air bubbles into the ink pack.

In the aforesaid embodiment, the body casing 31*a* is provided with the inner casing (frame portion) 31*d*, and the film F1 is bonded to the top face 31*d*1 of this inner casing 31*d*, thereby forming the airtight space S. However, the invention is not limited to this configuration. The body casing 31*a* may be formed with the airtight space S without being provided with the inner casing 31*d*. For example, the inner casing 31*d* and the first engaging portions K2 (128) are omitted from the body casing 31, and the second engaging portions K1 (130) are omitted from the lid portion 31*b*. Thereafter, the film F1 is bonded by thermal bonding to the tap face of the body casing 31 (top surface of the outer casing 31*c*), or the lid portion 31*b* is directly bonded thereto by ultrasonic bonding or the like without utilizing the film F1, thereby enabling formation of the airtight space S. Even in such a modified example, the second sealing film F2 is thermally bonded onto the annular projecting portion R2 formed on the opening edge of the opening portion 31*g* and onto the leading end portion R1 of the ink lead-out member 32*b*, whereby the gap D between the opening portion 31*g* and the ink lead-out member 32*b* can be easily sealed with this second sealing film F2. Accordingly, when the air lead-in port H is connected to the air lead-in tube, the space 5 is reliably maintained airtight.

In the aforesaid embodiment, the first engaging portions K2 (128) are provided in the groove portion between the outer casing 31*c* and the inner casing 31*d*, and the second engaging portions K1 (130) engage these first engaging portions K2 (128). A preferred structure of each first engaging portion K2 (128) and second engaging portion K1 (130) will now be described in detail according to FIGS. 8 to 11.

FIG. 8 omits the illustration of the members 33, 34, 35, and F2 shown in FIG. 4.) Besides, FIG. 8 shows the ink pack 32 being filled with ink, while FIG. 4 shows the ink pack 32 before being filled with ink. The filling of the ink pack 32 with ink may be performed before the ink pack 32 is housed in the ink casing 31, and may be performed after the ink pack 32 is housed in the ink casing 31.

Figure 9A:
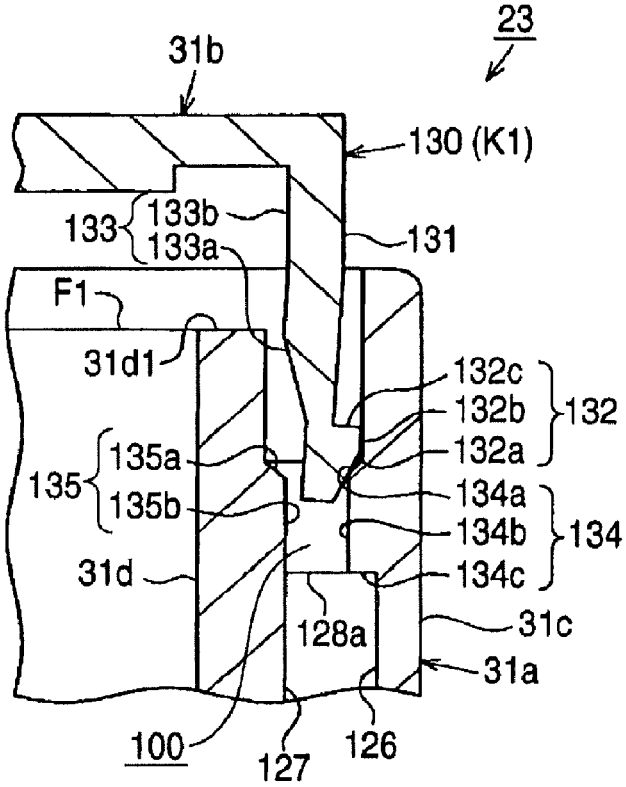
FIGS. 9(*a*) and 9(*b*) are an enlarged view of a section to illustrate a relationship between a first engaging portion and a second engaging portion, and an enlarged view of a section to illustrate a relationship between the first engaging portion and the second engaging portion, respectively.
Figure 9B:
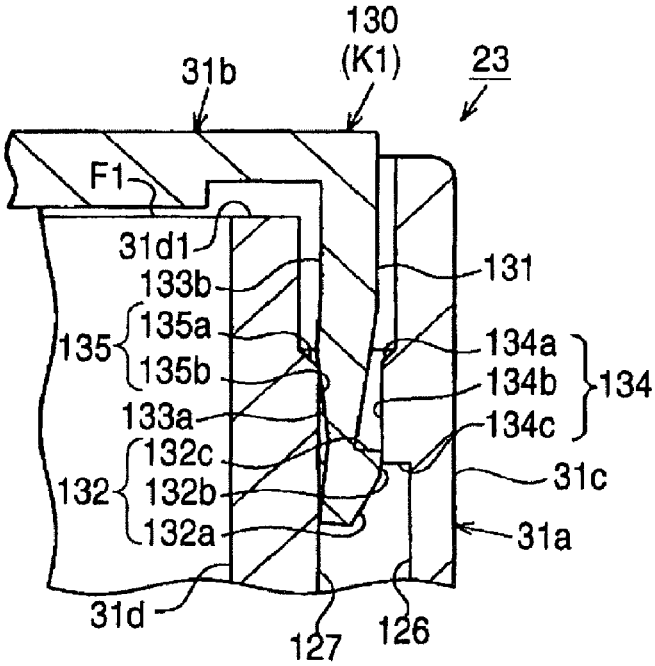
Figure 10:
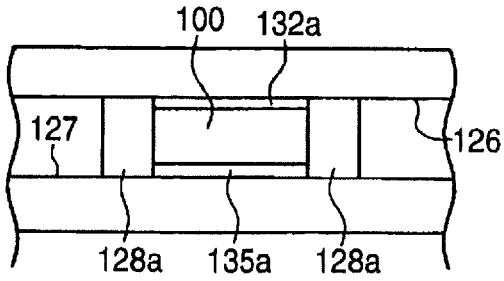
FIG. 10 is a top view to illustrate a configuration of the first engaging portion.
Figure 11:
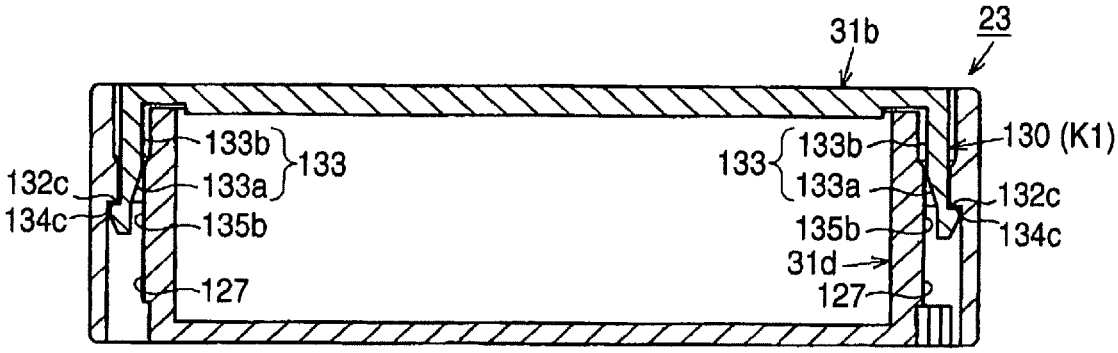
FIG. 11 is a sectional view of a cartridge casing, showing a state in which the first engaging portion and the second engaging portion are engaged together.

FIGS. 9(*a*) and 9(*b*) are enlarged views of a section to illustrate a relationship between the first engaging portion 128 and the second engaging portion 130. FIG. 10 is a top view to illustrate a configuration of the first engaging portion 128. FIG. 11 is a sectional view of the cartridge casing 31, showing a state in which the first engaging portion 128 and the second engaging portion 130 are engaged together.

As shown in FIG. 9(*a*), the second engaging portion 130 comprises a substrate 131, a claw portion 132 (preferably, like a hook), and a guide portion 133. This substrate 131, having flexibility, is formed extending downward from the lid portion 31*b*, and the claw portion 132 is formed on the outer side surface of the leading end portion of the substrate 131. That is, as shown in FIG. 9, this claw portion 132 is formed on the side of the lid portion 31*b* that is opposed directly to the inner wall surface 126 of the outer casing 31*c* when the lid portion 31*b* is attached to the outer casing 31*c*. Furthermore, this claw portion 132 includes a tapered portion 132*a* formed to taper downwardly of the outer side of the claw portion 132, an abutment portion 132*b* formed flat facing outward so as to continue to this tapered portion 132*a*, and an abutment portion 132*c* formed flat facing upward so as to continue to this abutment portion 132*b*. And, these tapered portion 132*a* and abutment portion 132*b* configure the second guide portion.

Thus, the claw portion 132 is configured to face outward, whereby as compared with when the claw portion 132 is configured to face inward, in case of injection molding the lid portion 31*b*, a mold tool therefor will not have a complicated structure, so that the lid portion 31*b* can be manufactured at low cost by injection molding.

Furthermore, the guide portion 133 serving as the third guide portion is formed on a surface (inside surface) of the substrate 131 opposite a surface thereof (outside surface) formed with the claw portion 132. As shown in FIG. 9, this guide portion 133 is formed so as to face inward (so as to be opposed directly to the outer wall surface 127 of the inner casing 31*d*) when the lid portion 31*b* is attached to the outer casing 31*c*. Furthermore, this guide portion 133 includes a tapered portion 133*a* formed to taper downwardly of the inner side of the guide portion 133 and an abutment portion 133*c* formed flat facing inward so as to continue to this tapered portion 133*a*.

At the same time, as shown in FIGS. 9(*a*) and 10 the first engaging portion 128 has a pair of connection pieces 128*a* providing a connection between the inner wall surface 126 of the outer casing 31*c* and the outer wall surface 127 of the inner casing (frame portion) 31*d*. The aforesaid second engaging portion 130 is inserted through an opening 100 surrounded by the pair of connection pieces 128*a*, the inner wall surface 126, and the outer wall surface 127.

A guide portion 134 serving as the first guide means is formed on the inner wall surface of the opening 100 of the first engaging portion 128, i.e., on the inner wall surface 126 of the outer casing 32*c*. This guide portion 134 includes a tapered portion 134*a* formed to taper upwardly of the inner side of the quid portion 134, an abutment portion 134*b* formed flat facing inward so as to continue to this tapered portion 134*a*, and a retention portion 134*c* formed flat facing downward so as to continue to this abutment portion 134*b*.

Besides, a guide portion 135 serving as the first guide means is formed on the inner side surface of the opening 100 of the first engaging portion 128, i.e., on the outer wall surface 127 of the inner casing 31*d*. This guide portion 135 includes a tapered portion 135*a* formed to taper upwardly of the outer side of the guide portion 135 and an abutment portion 135*b* formed flat facing outward so as to continue to this tapered portion 135*a*. And, the distance between the abutment portion 135*b* of the guide portion 135 and the abutment portion 134*b* of the guide portion 134 is made to match the thickness of the abutment portion 133*b* of the substrate 131.

When the first engaging portion 128 thus configured is engaged with the second engaging portion 130 thus configured, as shown in FIG. 9(*a*), first, the tapered portion 132*a* of the claw portion 132 abuts the tapered portion 134*a* of the guide portion 134. When the lid portion 31*b* is pressed downward from this position, the tapered portion 132*a* is configured to slide downward while abutting the tapered portion 134*a*.

And, when the lid portion 31*b* is pressed further downward, the tapered portion 132*a* is separated from the tapered portion 134*a*, while the abutment portion 132*b* continuing to the tapered portion 132*a* abuts the abutment portion 134*b* of the guide portion 134 and slides downward. Thereby, it is configured that the claw portion 132 is guided and also supported by the guide portion 134.

On this occasion, because having flexibility as aforesaid, the substrate 131 of the second engaging portion 130 slightly bends, inward, and when the lid portion 31*b* is pressed further downward from this position, as shown in FIG. 9(*b*), the tapered portion 133*a* of the guide portion 133 abuts the tapered portion 135*a* of the guide portion 135. And, the tapered portion 133*a* is configured to slide downward while keeping such abutment.

And, when the lid portion 31*b* is pressed further downward, the tapered portion 133*a* is separated from the tapered portion 135*a*, while the abutment portion 133*b* continuing to the tapered portion 133*a* abuts the abutment portion 135*b* of the guide portion 135 and slides downward. Thereby, it is configured that the guide portion 133 is guided and also supported by the guide portion 135.

And, when the lid portion 31*b* is pressed still further downward, the abutment portion 132*b* of the claw portion 132 is separated from the abutment portion 134*b* of the guide portion 134. Thereby, the substrate 131 of the second engaging portion 130 is restored outward. On this occasion, as shown in FIG. 11, the abutment portion 132*c* of the claw portion 132 abuts the retention portion 134*c* of the guide portion 134 in a mutually opposed relationship. That is, the first engaging portion 128 and the second engaging portion 130 are engaged together. And, the abutment portion 132*c* of the claw portion 132 abuts and engages the retention portion 134*c*, thereby restricting the lid portion 31*b* from moving upward. Thereby, the lid portion 31*c* is closely fixed to the outer casing 31*c*, thus sealing the opening portion of this outer casing 31*c*.

with such a configuration, when the lid portion 31*b* is attached to the outer casing 31*c*, the claw portion 132 and guide portion 133 of the second engaging portion 130 of the lid portion 31*b* are guided and also supported by the guide portions 134, 135 of the first engaging portion 128. Thereby, the lid portion 31*b* can be stably and smoothly attached to the outer casing 31*c*. Besides, on this occasion, the substrate 131 of the second engaging portion 130, since having flexibility as aforesaid, can bend slightly upon attachment. Thereby, even when the second engaging portion 130 of the lid portion 31*b* is formed slightly shifted widthwise or lengthwise of the outer casing 31*c* relative to the first engaging portion 128 due to an manufacturing error caused upon manufacture of the lid portion 31*b*, the second engaging portion 130 can be inserted through and engaged with the first engaging portion 128. Accordingly, even when the outer casing 31*c* or the lid portion 31*b* is formed slightly larger or smaller than each other due to a dimensional error, the lid portion 31*b* can be attached to the outer casing 31*c*.

Furthermore, as shown in FIG. 11, with the lid portion 31*b* being attached to the outer casing 31*c*, the abutment portion 133*b* of the guide portion 133 of the second engaging portion 130 is opposed directly to and ready to abut the abutment portion 135*b* of the guide portion 135. Accordingly, for example, when the lid portion 31*b* is pressurized via the film F1 by the inflow of air from the air pressure pump 25 and bulges upward, even when the second engaging portion 130 moves inward in response thereto, the abutment portion 133*b* is supported by the abutment portion 135*b*, thus restricting the second engaging portion 130 from moving. This movement of the second engaging portion 130 is restricted, whereby the abutment portion 132*c* of the claw portion 132 will not come off the retention portion 134*c* of the guide portion 134. As a result, the lid portion 31*b* does not come off the outer casing 31*c*, so that the reliability of the ink cartridge 23 can be improved.

Besides, with such a configuration, as shown in FIG. 11, with the lid portion 31*b* being attached to the outer casing 31*c*, it is configured that the engagement portion between the first engaging portion 128 and the second engaging portion 130 is covered with the outer wall of the casing 31*a*. Thereby, this engagement portion will not be subjected to an influence from the outside. Therefore, for example, the engagement portion can be prevented from coming out of engagement due to an impact from outside such as caused by a collision. Besides, the engagement portion is thus covered, thereby enabling simplification of the outer appearance of the state in which the lid portion 31*c* is attached to the casing 31*a*.

According this embodiment described above, the following advantageous effects are exerted.

(1) In this embodiment, the claw portion 132 of the second engaging portion 130 is configured to face outward. Thereby, the mold tool used in injection molding the lid portion 31*b* is prevented from having a complicated configuration as compared with when the claw portion 132 is configured to face inward. As a result, the lid portion 31*b* will be easy to manufacture by injection molding, thus enabling an improvement in production cost.

(2) In this embodiment, the second engaging portion 130 of the lid Portion 31*b* is provided with the claw portion 132 and furthermore, the inner wall surface 126 of the outer casing 31*c* is provided with the guide portion 134. With such a configuration, when the lid portion 31*b* is attached to the outer casing 31*c*, the claw portion 132 of the second engaging portion 130 is guided and also supported by this guide portion 134. Thereby, the lid portion 31*b* can be smoothly attached to the outer casing 31*c*. Besides, the abutment portion 132*c* of the claw portion 132 and the retention portion 134*c* of the guide portion 134 abut each other, thereby making it possible to restrict the lid portion 31*b* from moving upward. As a result, the lid portion 31*b* can be adhered and also fixed to the outer casing 31*c*.

(3) In this embodiment, the second engaging portion 130 of the lid portion 31*b* is provided with the guide portion 133 and furthermore, the outer wall surface 127 of the inner casing 31*d* is provided with the guide portion 135. With such a configuration, when the lid portion 31*b* is attached to the outer casing 31*c*, the guide portion 133 of the second engaging portion 130 is guided and also supported by this guide portion 135. Thereby, the lid portion 31*b* can be smoothly attached to the outer casing 31*c*. Besides, with the lid portion 31*b* being attached to the outer casing 31*c*, the abutment portion 133*b* of the guide portion 133 of the second engaging portion 130 abuts the abutment portion 135*b* of the guide portion 135 in a mutually opposed relationship. Accordingly, when the lid portion 31*b* is pressurized via the film F1 by the inflow of air from the air pressure pump 25 and bulges upward, even when the second engaging portion 130 moves inward in response thereto, the abutment portion 133*b* is supported by the abutment portion 135*b*, thus restricting the second engaging portion 130 from moving. Thereby, the abutment portion 132*c* of the claw portion 132 can be prevented from coming off the retention portion 134*c* of the guide portion 134. As a result, the lid portion 31*b* does not come off the outer casing 31*c*, so that the reliability of the ink cartridge 23 for housing the ink pack 32 can be improved. Furthermore, the reliability of the printer 11 including this ink cartridge 23 can be improved.

(4) In this embodiment, the substrate 131 of the second engaging portion 130 is configured to have flexibility. With such a configuration, the second engaging portion 130 can bend slightly when the lid portion 31*b* is attached to the outer casing 31*c*. Thereby, even when the second engaging portion 130 of the lid portion 31*b* is formed slightly shifted widthwise or lengthwise of the outer casing 31*c* relative to the first engaging portion 128 due to a manufacturing error caused upon manufacture of the lid portion 31*b*, the second engaging portion 130 can be inserted through the first engaging portion 128. As a result, even when the outer casing 31*c* or the lid portion 32*b* is formed slightly larger or smaller than each other due to a dimensional error, the lid portion 32*b* can be attached to the outer casing 31*c*.

Additionally, the ink cartridge having the aforesaid configuration of the first engaging portion K2 (128) and second engaging portion K1 (130) can be applied to the ink cartridge having the casing comprising the body casing and the lid portion. Accordingly, the aforesaid configuration of the first engaging portion K2 (128) and second engaging portion K1 (130) is not limited to the ink cartridge having the ink containing bag housed in the casing.

In the aforesaid embodiment, it is configured that there are provided six ink cartridges 23. However, any number of ink cartridges can be mounted en the printer 11.

In the aforesaid embodiment, the liquid container of the invention is embodied in the ink cartridge 7. However, the invention is not limited thereto but may be embodied in another container.

Each aforesaid embodiment has described the printer that ejects ink (printing apparatus including a facsimile machine, a copier, and the like) as an example of the liquid ejecting apparatus. However, the liquid ejecting apparatus may be a liquid ejecting apparatus that ejects another liquid. For example, the liquid ejecting apparatus may be: a liquid ejecting apparatus that ejects a liquid of electrode material, color material, or the like for use in manufacturing a liquid crystal display, an EL display, and a surface emission display; a liquid ejecting apparatus that ejects a biological organic material for use in manufacturing a biochip; and a sample ejecting apparatus serving as a precision pipette.

What is claimed is:

1. A liquid container, comprising:

a case;

a lid, configured to be attached to the case;

a frame body disposed inside of the case and having an opening;

a film, attached to the frame body and defining a space in the frame body for containing liquid therein;

a first engagement member, disposed in a second space defined between an outer face of the frame body and an inner face of the case; and a second engagement member, provided on the lid and configured to engage with the first engagement member when the lid is attached to the case.

2. The liquid container as set forth in claim 1, wherein:

the outer face of the case covers an engagement part in which the first engagement member and the second engagement member.

3. The liquid container as set forth in claim 1, wherein:

the first engagement member is formed with a hole; and the second engagement member is inserted into the hole.

4. The liquid container as set forth in claim 1, wherein:

the first engagement member includes a step portion provided on the inner face of the case; and the second engagement member includes a claw opposing the inner face of the case and configured to engage with the step portion when the lid is attached to the case.

5. The liquid container as set forth in claim 1, wherein:

the second engagement member includes a claw provided on a first face thereof; and the first engagement member includes a first part configured to engage with the claw and a second part configured to come in contact with a part of a second face of the second engagement member which is opposite to the first face, when the lid is attached to the case.

6. The liquid container as set forth in claim 5, wherein:

the first part of the first engagement member is disposed in a position closer to the outer face of the frame body, and the second part of the first engagement member is disposed in a position closer to the inner face of the case.

7. The liquid container as set forth in claim 1, further comprising:

a lead-out member, configured to lead out the liquid contained in the first space in cooperation with compressed air introduced into the first space.

* * * * *